US010632744B2

(12) United States Patent
Miyata et al.

(10) Patent No.: US 10,632,744 B2
(45) **Date of Patent: *Apr. 28, 2020**

(54) INKJET RECORDING APPARATUS

(71) Applicant: KYOCERA Document Solutions Inc., Osaka (JP)

(72) Inventors: Mitsuko Miyata, Osaka (JP); Erika Tanaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/216,353

(22) Filed: Dec. 11, 2018

(65) Prior Publication Data

US 2019/0193395 A1 Jun. 27, 2019

(30) Foreign Application Priority Data

Dec. 27, 2017 (JP) ..... 2017-251469

(51) Int. Cl.
*B41J 2/045* (2006.01)
*B41J 11/00* (2006.01)

(52) U.S. Cl.
CPC ..... *B41J 2/04573* (2013.01); *B41J 2/0458* (2013.01); *B41J 11/002* (2013.01)

(58) Field of Classification Search
CPC .... B41J 2/04573; B41J 2/0458; B41J 11/002; B41J 2/14088
See application file for complete search history.

(56) References Cited

U.S. PATENT DOCUMENTS 8,240,839 B2 * 8/2012 Yamanobe ..... B41J 2/0057 347/101
2016/0243837 A1 8/2016 Usui

FOREIGN PATENT DOCUMENTS

JP 2016-155240 A 9/2016

* cited by examiner

*Primary Examiner* — Thinh H Nguyen
(74) *Attorney, Agent, or Firm* — Stein IP, LLC

(57) ABSTRACT

An inkjet recording apparatus has a recording head, a thermal head, and a heat control portion. The recording head has an ink discharge surface. The thermal head is arranged opposite the ink discharge surface across a recording medium conveyance passage, and heats the recording medium. The thermal head is provided with a plurality of element arrays in the width direction, the element arrays each having a plurality of heating elements arrayed in the recording medium conveyance direction. The heat control portion makes generate heat at least some heating elements in the element arrays corresponding to the ink discharge ports through which ink is discharged.

6 Claims, 7 Drawing Sheets

INKJET RECORDING APPARATUS

INCORPORATION BY REFERENCE

This application is based upon and claims the benefit of priority from the corresponding Japanese Patent Application No. 2017-251469 filed on Dec. 27, 2017, the entire contents of which are incorporated herein by reference.

BACKGROUND

The present disclosure relates to an inkjet recording apparatus provided with a recording head which discharges ink to a recording medium and a thermal head which heats the recording medium.

As a recording apparatus which performs printing on a recording medium such as paper, plastic film, cloth, or the like, an inkjet recording apparatus which forms images by discharging ink is widely used for forming high-resolution images.

In such an inkjet recording apparatus, the ink discharged to the recording medium may sometimes mix with ink discharged from the downstream-side recording head in the recording medium conveyance direction, or may attach (move) to a conveying roller pair arranged on the downstream side in the recording medium conveyance direction. To prevent such color mixing and soiling, a heating device which heats ink on the recording medium can be provided near the downstream side of the recording head.

SUMMARY

According to one aspect of the present disclosure, an inkjet recording apparatus includes a recording head, a thermal head, and a heat control portion. The recording head has an ink discharge surface in which a plurality of ink discharge ports are open through which ink is discharged to a recording medium. The thermal head is arranged opposite the ink discharge surface across a recording medium conveyance passage, and heats the recording medium. The heat control portion controls the thermal head. The thermal head is provided with a plurality of element arrays in the width direction orthogonal to the recording medium conveyance direction such that the element arrays each correspond to one or more ink discharge ports, the element arrays each having a plurality of heating elements arrayed in the recording medium conveyance direction. The element arrays are arranged, with respect to the recording medium conveyance direction, at least on the downstream side of a landing position at which the ink discharged through the ink discharge ports lands on the recording medium. The heat control portion can selectively make the plurality of heating elements generate heat, makes generate heat at least some heating elements in the element arrays corresponding to the ink discharge ports through which ink is discharged, and makes a heating region generate heat in coordination with timing with which an ink dot on the recording medium passes through the recording medium conveyance passage, the heating region being where the heating elements in the element arrays are made to generate.

Further features and advantages of the present disclosure will become apparent from the description of embodiments given below.

DETAILED DESCRIPTION

Hereinafter, an embodiment of the present disclosure will be described with reference to the accompanying drawings.

Figure 1:
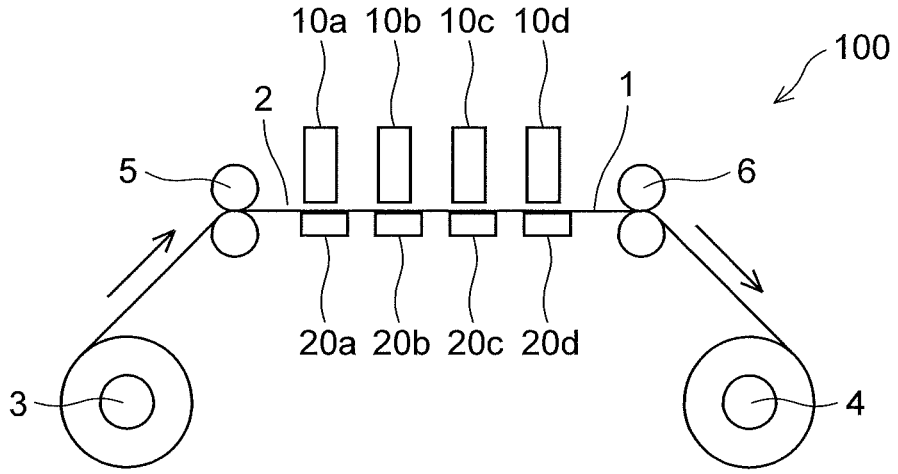
FIG. 1 is a schematic diagram showing an overall structure of an inkjet recording apparatus according to one embodiment of the present disclosure.

As shown in FIG. 1, an inkjet recording apparatus 100 according to one embodiment of the present disclosure discharges ink to a recording medium 1 to perform image formation, and includes, along a recording medium conveyance passage 2, a plurality of (here, four) recording heads 10*a*, 10*b*, 10*c*, and 10*d*.

In this embodiment, the recording medium 1 is wound in a roll. As the recording medium 1, plastic film, paper (such as plain paper or glossy paper), or cloth can be used.

The inkjet recording apparatus 100 includes a feeding rotary shaft 3 which feeds out the recording medium 1 from a roll, a winding rotary shaft 4 which winds up around a roll the recording medium 1 on which an image has been formed, a conveying roller pair 5 which conveys the recording medium 1 to the recording heads 10*a* to 10*d*, a conveying roller pair 6 which conveys the recording medium 1 having an image formed on it to the winding rotary shaft 4, and a plurality of (here, four) thermal heads 20*a*, 20*b*, 20*c*, and 20*d* which heat the recording medium 1.

The recording medium 1 fed out by the feeding rotary shaft 3 is subjected to image formation by the recording heads 10*a* to 10*d*, is then dried to a certain degree (dried preliminarily) while passing across the thermal heads 20*a* to 20*d*, and is then wound up by the winding rotary shaft 4. Since the thermal heads 20*a* to 20*d* dry the ink on the recording medium 1 to a certain degree (drying preliminarily), the ink seldom attaches to the conveying roller pair 6 or to the reverse side of the recording medium 1 after the winding-up; even so, a heating element can be provided as necessary on the downstream side of the thermal head 20*d* in the recording medium conveyance direction.

The recording heads 10*a* to 10*d* are arranged at such a height as to form a predetermined gap from the top surfaces of the thermal heads 20*a* to 20*d*, and are formed so as to extend along the width direction orthogonal to the recording medium conveyance direction (that is, along the direction perpendicular to the plane of FIG. 1).

Figure 2:
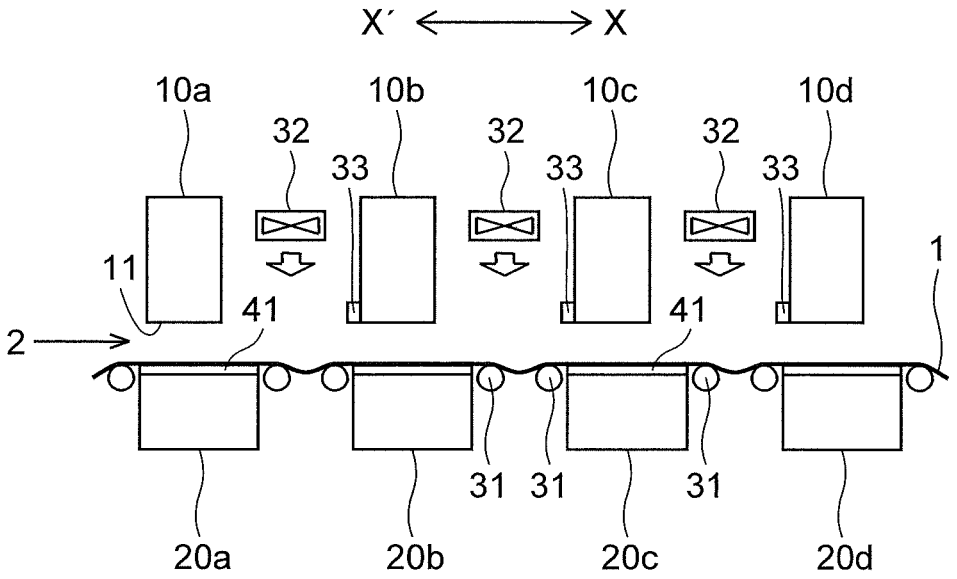
FIG. 2 is a diagram showing a structure around recording heads and thermal heads in the inkjet recording apparatus according to the one embodiment of the present disclosure.
Figure 3:
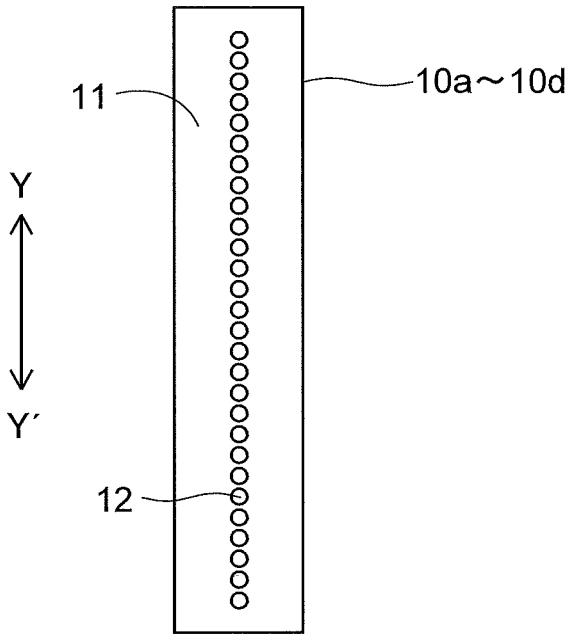
FIG. 3 is a diagram of the recording head in the inkjet recording apparatus according to the one embodiment of the present disclosure as seen from the ink discharge surface side.

As shown in FIGS. 2 and 3, in an ink discharge surface 11 of each of the recording heads 10*a* to 10*d*, there are arranged a plurality of ink discharge ports 12 at a predetermined pitch in the width direction (the direction indicated by arrows Y and Y', the main scanning direction). The plurality of ink discharge ports 12 do not have to be arranged on a straight line in the width direction; they may instead be arranged in a staggered array, or in a row inclined with respect to the width direction.

The recording heads 10*a* to 10*d* correspond to, for example, cyan, magenta, yellow, and black respectively, and discharge aqueous ink of the different colors through the plurality of ink discharge ports 12. In this way, a color image is formed on the recording medium 1.

Figure 4:
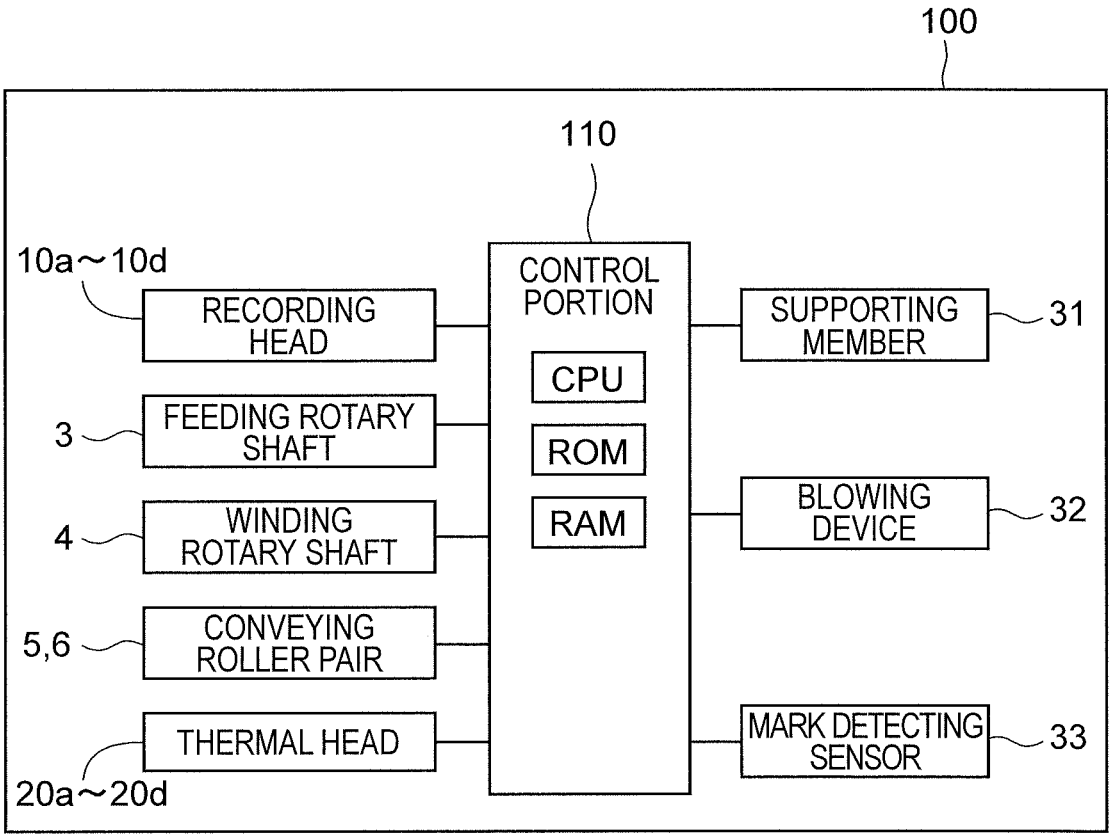
FIG. 4 is a block diagram illustrating controlling paths in the inkjet recording apparatus according to the one embodiment of the present disclosure.

As shown in FIG. 4, a control portion 110 of the inkjet recording apparatus 100 includes a CPU (central processing unit), ROM (read-only memory), RAM (random-access memory), and the like. The control portion 110 can control the recording heads 10*a* to 10*d*, the feeding rotary shaft 3, the winding rotary shaft 4, the conveying roller pairs 5 and 6, the thermal heads 20*a* to 20*d*, and the like, and thus can control the entire inkjet recording apparatus 100. The control portion 110 can control a supporting member 31 and a blowing device 32, of which both will be described later, and can communicate with a mark detecting sensor 33.

The ROM stores data that is not changed during the use of the inkjet recording apparatus 100, such as control programs for the inkjet recording apparatus 100, numerical values necessary for control, and the like. The RAM stores necessary data produced in the process of controlling the inkjet recording apparatus 100, data needed preliminarily to control the inkjet recording apparatus 100, and the like.

The control portion 110 can communicate with an operation panel or a personal computer (of which neither is illustrated) to which information on the kind of the recording medium 1 or the like is entered by the user, and thus acquires (receives) information from the operation panel or the personal computer. The control portion 110 determines the amount of ink to be discharged through the ink discharge ports 12 according to image data received from, for example, the personal computer, and determines the conveyance speed of the recording medium 1 according to the kind of the recording medium 1, a setting of the printing speed made by the user, and the like.

Here, in this embodiment, as shown in FIG. 2, the thermal heads 20*a* to 20*d* are arranged opposite the ink discharge surfaces 11 of the recording heads 10*a* to 10*d*, respectively, across the recording medium conveyance passage 2, and heat the recording medium 1 from the reverse side (the side opposite from the recording side).

The recording heads 10*a* to 10*d* are arranged at predetermined intervals along the recording medium conveyance direction (the direction indicated by arrow X), and the thermal heads 20*a* to 20*d* too are arranged at predetermined intervals along the recording medium conveyance direction. On the upstream side and the downstream side of each of the thermal heads 20*a* to 20*d* in the recording medium conveyance direction, supporting members 31 which support the recording medium 1 are arranged respectively. That is, at least one supporting member 31 is (here, two supporting members 31 are) arranged between adjacent ones of the thermal heads 20*a* to 20*d*. The topmost part of the supporting member 31 is positioned at a height equal to or slightly lower than that of the top surface of the thermal heads 20*a* to 20*d* (the bottom surface of the recording medium conveyance passage 2; in this embodiment, the top surface of a slide layer 41, which will be described later).

The supporting member 31 here is formed as a conveying roller which is rotated by a rotation driving force from a driving source (unillustrated). The supporting member 31 may instead be formed as a following roller or as a guide member which guides the recording medium 1.

Between adjacent ones of the recording heads 10*a* to 10*d*, there are respectively provided blowing devices 32 which each comprise a fan and which blow air toward the recording medium 1 through the gaps between the recording heads 10*a* to 10*d*. Thus, with a current of air, the recording medium 1 is put in close contact with the top surfaces of the thermal heads 20*a* to 20*d* (with the bottom surface of the recording medium conveyance passage 2). While, in FIG. 2, the blowing devices 32 are provided between adjacent ones of the recording heads 10*a* to 10*d* respectively, that is, a total of three blowing devices 32 are provided, it is not essential to arrange the blowing devices 32 between adjacent ones of the recording heads 10*a* to 10*d*. For example, ducts may be arranged between adjacent ones of the recording heads 10*a* to 10*d* respectively, and a single blowing device 32 which feeds air into all the ducts may be provided. Even in this case, it is possible to blow air through the gaps between the recording heads 10*a* to 10*d* toward the recording medium 1. When the inkjet recording apparatus 100 is large (for example, when the intervals between the recording heads 10*a* to 10*d* are equal to or larger than 50 cm), the self-weight of the recording medium 1 puts it in close contact with the top surfaces of the thermal heads 20*a* to 20*d* (the bottom surface of the recording medium conveyance passage 2); thus, there is no need to provide the blowing devices 32.

With the supporting members 31 provided between adjacent ones of the thermal heads 20*a* to 20*d*, it is possible to prevent the recording medium 1 from sagging down between adjacent ones of the thermal heads 20*a* to 20*d*. However, with the provision of the blowing devices 32, depending on the thickness and stiffness of the recording medium 1, the recording medium 1 may sag down between adjacent ones of the thermal heads 20*a* to 20*d*. In this case, the recording medium 1 reaches the thermal heads 20*b*, 20*c*, and 20*d* with timing delayed to a degree corresponding to the amount of sagging; this leads to color misalignment.

Figure 5:
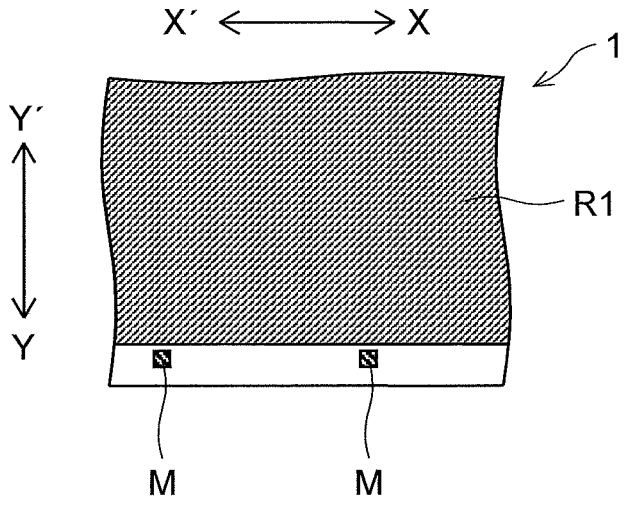
FIG. 5 is a diagram showing a recording medium having reference marks printed on it by the inkjet recording apparatus according to the one embodiment of the present disclosure.

Thus, in this embodiment, out of the recording heads 10*a* to 10*d*, the recording head (the most upstream-side head) 10*a* arranged on the most upstream side is configured to print reference marks M (see FIG. 5) on the recording medium 1 for timing correction. The reference marks M are printed outside a print region R1, for example, with a size of 2 mm×2 mm, at a pitch of several centimeters. In FIG. 5, to facilitate understanding, the reference marks M and the print region R1 are indicated by hatching. For each of the recording heads 10*b* to 10*d* but the recording head 10*a*, a reflective or transmissive mark detecting sensor (a mark detecting portion) 33 is provided which detects a reference mark M. The result of detection by the mark detecting sensor 33 is transmitted to the control portion 110.

Then, the control portion (head control portion) 110 corrects the ink discharge timing of the recording heads 10*b* to 10*d* based on the detection timing with which the mark detecting sensors 33 detect the reference marks M. Thus, even when the recording medium 1 sags down between adjacent ones of the thermal heads 20*a* to 20*d*, it is possible to prevent color misalignment.

On the top surfaces of the thermal heads 20*a* to 20*d* (the surfaces of the thermal heads 20*a* to 20*d* facing the recording heads 10*a* to 10*d*), there are respectively provided slide layers 41 on which the recording medium 1 slides while in contact with the slide layers 41. Thus, it is possible to prevent the recording medium 1 from being scratched while the recording medium 1 passes across the thermal heads 20*a* to 20*d*.

In this embodiment, the slide layer 41 is formed with a thin-layer hard glass plate. The slide layer 41 is formed to have a thickness of 100 μm or smaller, and preferably a thickness of 20 μm or smaller.

The slide layer 41 may instead be formed of resin. In this case, from the perspective of heat-resistance, the slide layer 41 is, preferably, formed of polyimide or polyamide-imide. With polyimide or polyamide-imide, it is possible to easily form the slide layer 41 with a thickness of 20 μm or smaller. To reduce the friction coefficient of the slide layer 41 with respect to the recording medium 1, the surface (the top surface) of the slide layer 41 to be in contact with the recording medium 1 may be coated with fluororesin such as PTFE (polytetrafluoroethylene), PFA (tetrafluoroethylene-perfluoro alkyl vinyl ether copolymer), or FEP (tetrafluoroethylene-hexafluoropropylene copolymer).

Figure 6:
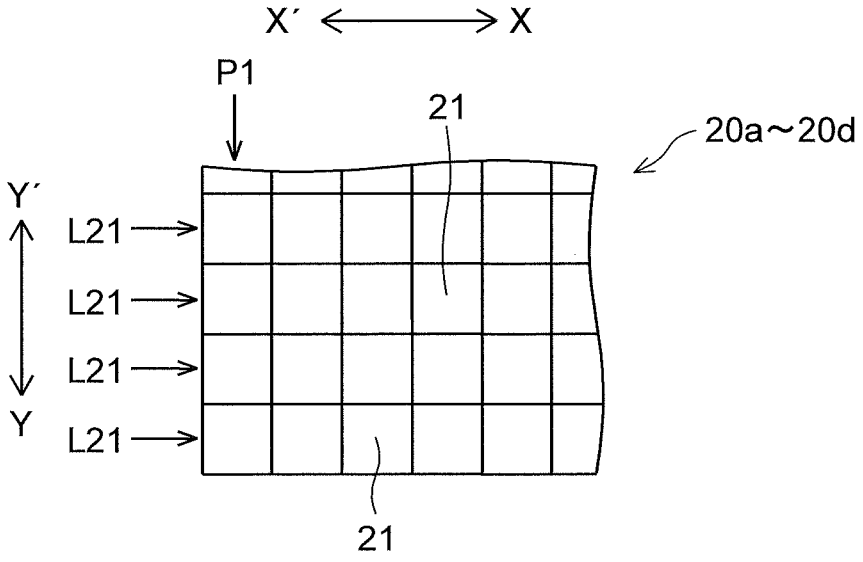
FIG. 6 is a diagram showing a structure of the thermal head in the inkjet recording apparatus according to the one embodiment of the present disclosure.

In this embodiment, as shown in FIG. 6, the thermal heads 20*a* to 20*d* are each provided with a plurality of heating elements 21. The heating elements 21 are arrayed in the recording medium conveyance direction (the direction indicated by arrow X), and thereby constitute element arrays L21 extending in the recording medium conveyance direction. A plurality of element arrays L21 are provided in the width direction (the direction indicated by arrows Y and Y') to correspond to one or more ink discharge ports 12 (see FIG. 3).

The element arrays L21 are arranged, with respect to the recording medium conveyance direction (the direction indicated by arrow X), at least on the downstream side of a landing position P1 (a position right under the ink discharge port 12) at which the ink discharged through the ink discharge port 12 lands on the recording medium 1. Here, the element arrays L21 are arranged from the landing position P1 (or a position slightly on the upstream side of the landing position P1 in the recording medium conveyance direction (the direction indicated by arrow X')) toward the downstream side of the landing position P1 in the recording medium conveyance direction (the direction indicated by arrow X).

The heating elements 21 each include a heating resistor, a thin-film transistor, an individual electrode, a common electrode, and the like (none of these is illustrated). The control portion (heat control portion) 110 can selectively make the plurality of the heating elements 21 generate heat.

The control portion 110 makes generate heat some heating elements 21 in the element line L21 corresponding to the ink discharge ports 12 through which ink is discharged, and thereby dries (preliminarily dries) the ink on the recording medium 1 to a certain degree before the recording medium 1 reaches the next recording head 10*b*, 10*c*, or 10*d* or the conveying roller pair 6. Here, since aqueous ink is used, the control portion 110 sets the amount of heat generated by the heating elements 21 such that the top surface (the surface on which the ink lands) of the recording medium 1 becomes substantially 100° C.

There are various ways to set a heating region R21 in which the heating elements 21 generate heat.

Figure 7:
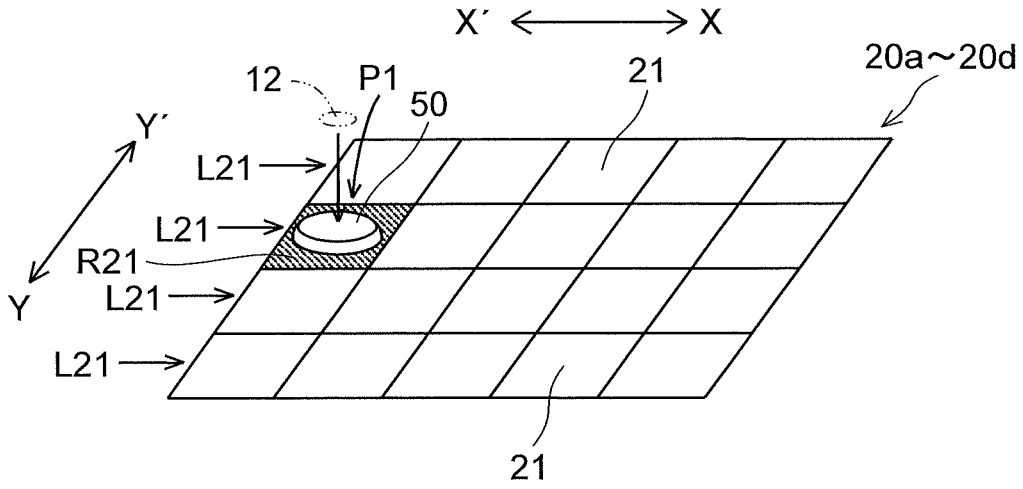
FIG. 7 is a diagram illustrating a method for setting a heating region of the thermal head in the inkjet recording apparatus according to the one embodiment of the present disclosure, showing an example in which only a heating element located at a landing position is made to generate heat.

For example, as shown in FIG. 7, the control portion 110 can make only a heating element 21 located at the landing position P1 generate heat. With this configuration, when the ink 50 discharged through the ink discharge ports 12 lands on the recording medium 1, the ink 50 on the recording medium 1 is preliminarily dried. To facilitate understanding, in FIGS. 7 to 11, the heating region R21 in which the heating elements 21 generate heat is indicated by hatching while the recording medium 1 is omitted from illustration.

Figure 8:
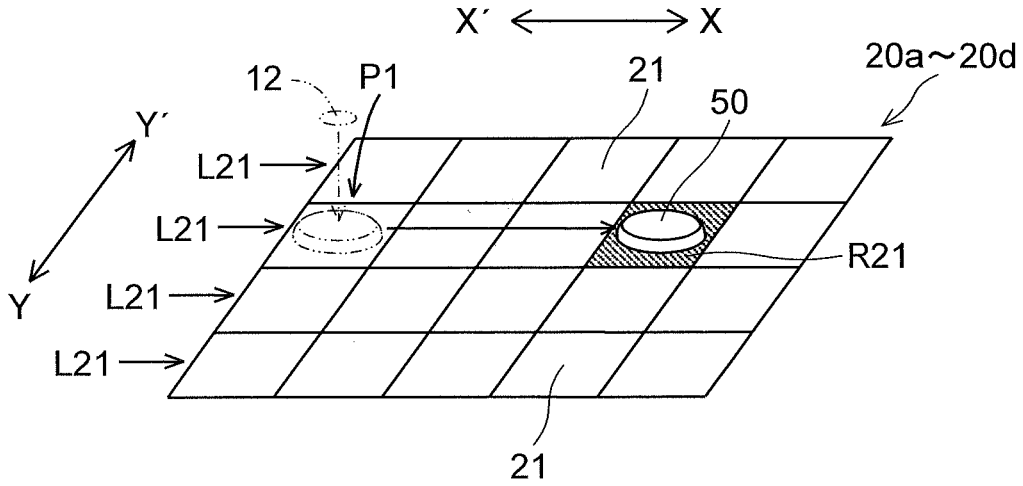
FIG. 8 is a diagram illustrating a method for setting the heating region of the thermal head in the inkjet recording apparatus according to the one embodiment of the present disclosure, showing an example in which only a heating element located on the downstream side of the landing position in the recording medium conveyance direction is made to generate.

As shown in FIG. 8, the control portion 110 can make generate heat only a heating element 21 located on the downstream side of the landing position P1 in the recording medium conveyance direction (the direction indicated by arrow X). With this configuration, when the ink 50 on the recording medium 1 passes across the heating region R21, the ink 50 on the recording medium 1 is preliminarily dried.

Figure 9:
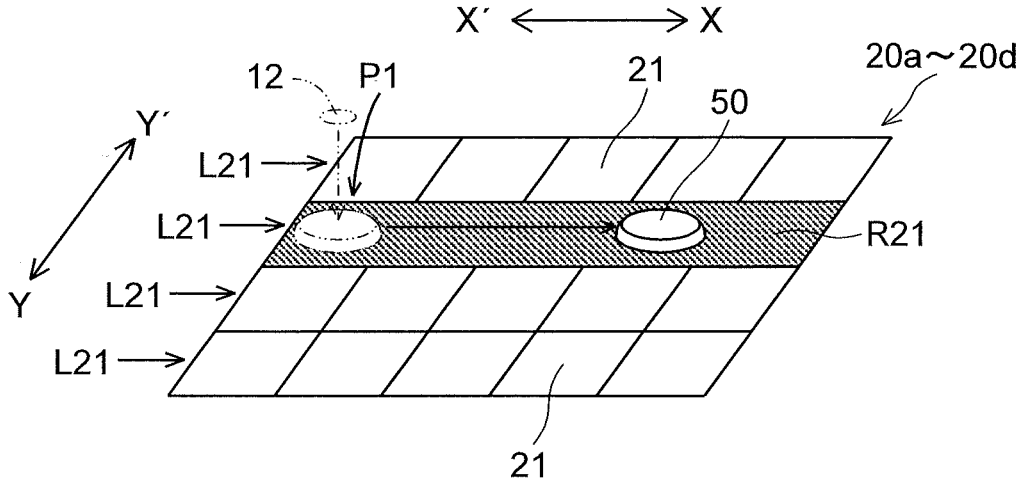
FIG. 9 is a diagram illustrating a method for setting the heating region of the thermal head in the inkjet recording apparatus according to the one embodiment of the present disclosure, showing an example in which heating elements located in a predetermined range on the downstream side of the landing position in the recording medium conveyance direction are made to generate.

As shown in FIG. 9, the control portion 110 can make generate heat heating elements 21 located in a predetermined range extending from the landing position P1 (or from a position on the downstream side of the landing position P1 in the recording medium conveyance direction) to the downstream side in the recording medium conveyance direction (to the right side in FIG. 9). That is, the control portion 110 can form the heating region R21 such that this extends in the recording medium conveyance direction. With this configuration, it is possible to increase the ink heating duration; thus, it is possible to reduce the amount of heat generated by each of the heating elements 21. Here, the recording medium 1 can be preliminarily dried with the temperature of the top surface of the recording medium 1 lowered, for example, to 80° C. to 85° C.; thus, even when resin such as PP (polypropylene) having relatively low resistance to heat is used as the recording medium 1, it is possible to prevent the recording medium 1 from thermally shrinking (thermally deforming).

In the configurations in FIGS. 7, 8, and 9, the control portion 110 makes the heating region R21 generate heat with it at rest at a predetermined position.

Figure 10:
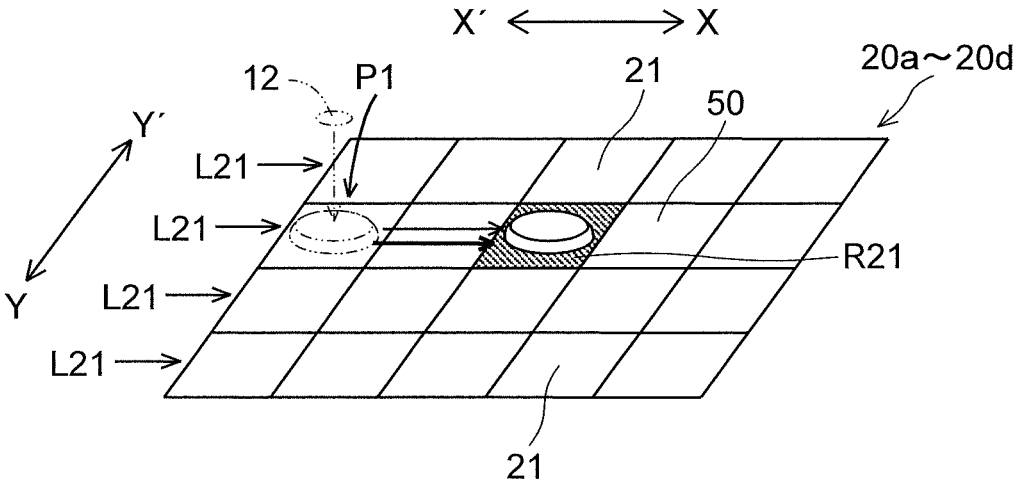
FIG. 10 is a diagram illustrating a method for setting the heating region of the thermal head in the inkjet recording apparatus according to the one embodiment of the present disclosure, showing an example in which the heating region is moved according to the movement of the ink.
Figure 11:
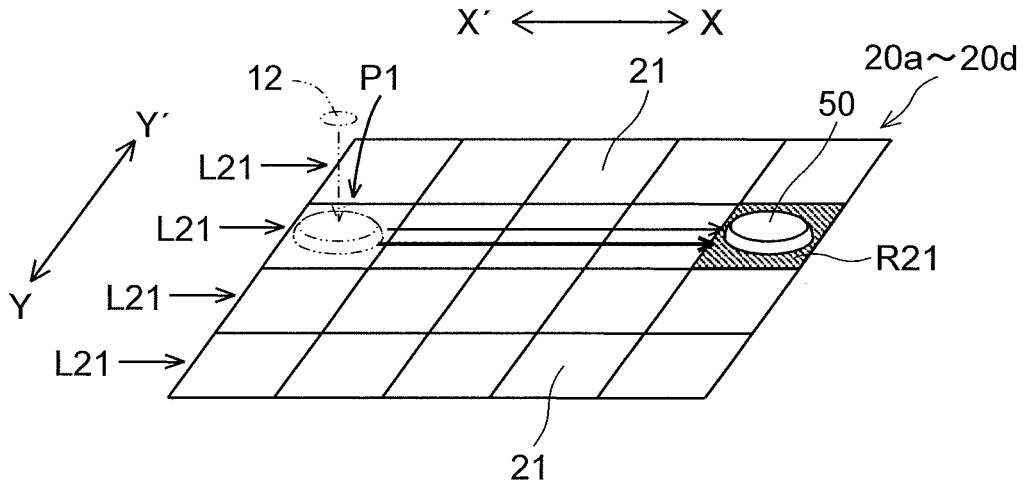
FIG. 11 is a diagram illustrating a method for setting the heating region of the thermal head in the inkjet recording apparatus according to the one embodiment of the present disclosure, showing a state in which the ink and the heating region are moved further to the downstream side in the recording medium conveyance direction from the state in FIG. 10.

As shown in FIGS. 10 and 11, the heating region R21 can be moved to the downstream side in the recording medium conveyance direction according to the movement of the ink 50 on the recording medium 1. With this configuration, as in the case of FIG. 9, it is possible to increase the ink heating duration; thus, it is possible to reduce the amount of heat generated by each of the heating elements 21. It is also possible to preliminarily dry the recording medium 1 with the temperature of the top surface of the recording medium 1 lowered, for example, to about 80° C. to 85° C. In FIGS. 10 and 11, the movement of the heating region R21 is indicated by a thick arrow.

Here, in this embodiment, depending on how quickly the ink 50 on the recording medium 1 dries, the control portion 110 can change at least either the amount of heat generated in the heating region R21 or the length of the heating region R21 in the recording medium conveyance direction.

Specifically, according to the amount of ink discharged through the ink discharge port 12 (the amount of ink per dot), the control portion 110 can change at least either the amount of heat generated in the heating region R21 or the length of the heating region R21. In this case, when the amount of ink discharged through the ink discharge port 12 is large (when the ink 50 does not dry quickly), the control portion 110 increases the amount of heat generated in the heating region R21 or increases the length of the heating region R21. On the other hand, when the amount of ink discharged through the ink discharge port 12 is small (when the ink 50 dries quickly), the control portion 110 reduces the amount of heat generated in the heating region R21 or reduces the length of the heating region R21.

Also according to the kind of the recording medium 1, the control portion 110 can change at least either the amount of heat generated in the heating region R21 or the length of the heating region R21. In this case, for example, when the thickness of the recording medium 1 is large (when the ink does not dry quickly), the control portion 110 increases the amount of heat generated in the heating region R21 or increases the length of the heating region R21. On the other hand, when the thickness of the recording medium 1 is small (when the ink dries quickly), the control portion 110 reduces the amount of heat generated in the heating region R21 or reduces the length of the heating region R21. For another example, when a recording medium 1 that has a slippery surface and is not very permeable to the ink 50, such as label paper or film, is used (when the ink does not dry quickly), the control portion 110 increases the amount of heat generated in the heating region R21 or increases the length of the heating region R21. On the other hand, when a recording medium 1 that is easily permeable to the ink 50, such as plain paper, is used (when the ink dries quickly), the control portion 110 reduces the amount of heat generated in the heating region R21 or reduces the length of the heating region R21.

When the heating methods shown in FIGS. 7 to 11 are adopted, depending on how quickly the ink 50 on the recording medium 1 dries, the control portion 110 can change the amount of heat generated in the heating region R21. When the heating method shown in FIG. 9 is adopted, depending on how quickly the ink 50 on the recording medium 1 dries, the control portion 110 can change the length of the heating region R21 in the recording medium conveyance direction.

In this embodiment, according to the conveying speed of the recording medium 1, the control portion 110 can change at least either the amount of heat generated in the heating region R21 or the length of the heating region R21 in the recording medium conveyance direction.

In this case, when the conveying speed of the recording medium 1 is high (in high-speed printing), the control portion 110 increases the amount of heat generated in the heating region R21 or increases the length of the heating region R21. On the other hand, when the conveying speed of the recording medium 1 is low (in low-speed printing), the control portion 110 reduces the amount of heat generated in the heating region R21 or reduces the length of the heating region R21.

When the heating methods shown in FIGS. 7 to 11 are adopted, according to the conveying speed of the recording medium 1, the control portion 110 can change the amount of heat generated in the heating region R21. When the heating method shown in FIG. 9 is adopted, according to the conveying speed of the recording medium 1, the control portion 110 can change the length of the heating region R21 in the recording medium conveyance direction.

In this embodiment, the heating region R21 is arranged substantially opposite the region across which the ink (hereinafter, also referred to as an ink dot) 50 on the recording medium 1 passes. In this specification, the phrase "the heating region is arranged substantially opposite the region across which the ink dot on the recording medium passes" means that the heating region is arranged such that 50% or more of the area of the ink dot passes across the heating region. Here, the heating region R21 is arranged such that 80% or more of the area of the ink dot 50 passes across the heating region R21. That is, the element arrays L21 of the thermal heads 20*a* to 20*d* are provided with high accuracy without deviating in the width direction (the direction indicated by arrows Y and Y') with respect to the ink discharge ports 12 in the recording heads 10*a* to 10*d*.

In this embodiment, the control portion 110 makes the heating region R21 generate heat in coordination with the timing with which the ink dot 50 on the recording medium 1 passes through the recording medium conveyance passage 2. Specifically, the control portion 110 makes the heating region R21 generate heat with predetermined timing based on the conveying speed of the recording medium 1 and the distance from the landing position P1 to the heating region R21. The timing with which the heating region R21 is made to generate heat is, as with the above-described ink discharge timing, corrected by the control portion 110 based on the timing with which the mark detecting sensors 33 detect the reference marks M.

For example, in a case in which the heating method shown in FIG. 7 is adopted, the control portion 110 makes the heating region R21 generate heat when the ink 50 lands on the recording medium 1 (or slightly before the ink 50 lands on the recording medium 1 with consideration given to the time required to raise the temperature), and makes the heating region R21 stop generating heat immediately after the ink dot 50 has passed across the heating region R21.

In a case in which the heating method shown in FIG. 8 is adopted, the control portion 110 makes the heating region R21 generate heat when the ink dot 50 reaches the heating region R21 (or slightly before the ink dot 50 reaches the heating region R21 with consideration given to the time required to raise the temperature), and makes the heat region R21 stop generating heat immediately after the ink dot 50 has passed across the heating region R21.

In a case in which the heating method shown in FIG. 9 is adopted, the control portion 110 makes the heating region R21 generate heat when the ink 50 lands on the recording medium 1 (or slightly before the ink 50 lands on the recording medium 1 with consideration given to the time required to raise the temperature), and makes the heating region R21 stop generating heat immediately after the ink dot 50 has passed across the heating region R21.

In a case in which the heating methods shown in FIGS. 10 and 11 are adopted, the control portion 110 switches on and off the heating elements 21 sequentially such that the ink dot 50 is located always on the heating region R21, and moves the heating region R21 to the downstream side in the recording medium conveyance direction at the same speed as the moving speed of the ink dot 50 (the conveying speed of the recording medium 1).

The control portion 110, when making the heating region R21 generate heat in coordination with the timing with which the ink dot 50 passes across the heating region R21, makes the heating region R21 generate heat with the timing with which the ink dot 50 is located substantially opposite the heating region R21 while the heating region R21 is generating heat. In this specification and the claims, the phrase "the ink dot is located substantially opposite the heating region while the heating region is generating heat" means that 50% or more of the area of the ink dot passes across the heating region while the heating region is generating heat (is located to overlap the heating region while the heating region is generating heat). Here, the control portion 110 makes the heating region R21 generate heat with the timing with which 80% or more of the area of the ink dot 50 passes across the heating region R21 while the heating region is generating heat.

Figure 12:
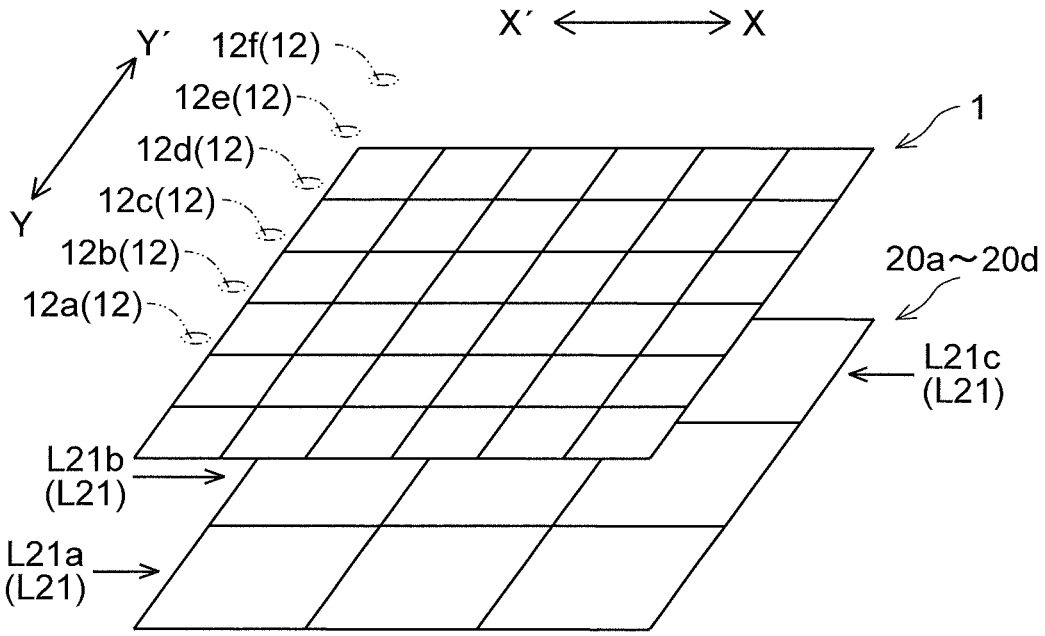
FIG. 12 is a diagram illustrating one example of the relationship between element arrays and ink discharge ports in the thermal head in the inkjet recording apparatus according to the one embodiment of the present disclosure.

To facilitate understanding, FIGS. 7 to 11 show a plurality of element arrays L21 provided in the width direction (the direction indicated by arrows Y and Y') such that one element line L21 corresponds to one ink discharge port 12. Instead, as shown in FIG. 12, a plurality of element arrays L21 may be provided in the width direction (the direction indicated by arrows Y and Y') such that one element line L21 corresponds to two or more (in FIG. 12, two) ink discharge ports 12.

That is, an element line L21*a* may be provided to correspond to ink discharge ports 12*a* and 12*b*, an element line L21*b* may be provided to correspond to ink discharge ports 12*c* and 12*d*, and an element line L21*c* may be provided to correspond to ink discharge ports 12*e* and 12*f*. In this case, for example, when at least either the ink discharge port 12*a* or 12*b* discharges ink, a predetermined region (the heating region R21) in the element line L21*a* is made to generate heat.

In this embodiment, as described above, the thermal heads 20*a* to 20*d* are provided which are arranged opposite the ink discharge surfaces 11 of the recording heads 10*a* to 10*d* across the recording medium conveyance passage 2 and which heat the recording medium 1. Thus, as compared with a case in which a heating device which heats the recording medium 1 is provided on the same side as the recording heads 10*a* to 10*d* with respect to the recording medium conveyance passage 2, it is possible to prevent surplus heat from conducting to the recording heads 10*a* to 10*d*, and thus to prevent the temperature of the recording heads 10*a* to 10*d* from rising. This helps prevent the ink 50 inside the ink discharge ports 12 in the recording heads 10*a* to 10*d* from drying and solidifying, and thus helps prevent clogging in the ink discharge ports 12. It is thus possible, while preventing the temperature of the recording heads 10*a* to 10*d* from rising, to heat the ink 50 on the recording medium 1.

The control portion 110 can selectively make the plurality of heating elements 21 generate heat, and makes generate heat at least some heating elements 21 in the element line L21 corresponding to the ink discharge ports 12 through which ink is discharged. Thus, unlike in a case in which the entire thermal heads 20*a* to 20*d* are made to generate heat, it is possible to make only a necessary part (at least some heating elements 21 in the element line L21 corresponding to the ink discharge ports 12 through which ink is discharged) generate heat; this makes it possible to dry the ink dot 50 on the recording medium 1 efficiently with a small amount of heat, and to prevent surplus heat from conducting to the recording heads 10*a* to 10*d*.

The control portion 110 makes the heating region R21 generate heat in coordination with the timing with which the ink dot 50 on the recording medium 1 passes through the recording medium conveyance passage 2. This makes it possible to reduce heat loss by making the heating region R21 generate heat only for a necessary time; it is thus possible to efficiently dry the ink dot 50 on the recording medium 1, and to prevent surplus heat from conducting to the recording heads 10*a* to 10*d*.

As described above, when the plurality of recording heads 10*a* to 10*d* are provided along the recording medium conveyance direction, the ink dot 50 on the recording medium 1 discharged through the recording heads 10*a* to 10*d* can be dried to a certain degree (dried preliminarily) by the thermal heads 20*a* to 20*d* before reaching the next recording head 10*b*, 10*c*, or 10*d*, or the conveying roller pair 6. This helps prevent color mixing of the ink dot 50 and attachment of the ink dot 50 to the conveying roller pair 6; it is thus possible to prevent image quality degradation.

As described above, the control portion 110 makes the heating region R21 generate heat with predetermined timing based on the conveying speed of the recording medium 1 and the distance from the landing position P1 to the heating region R21. This makes it possible to easily make the heating region R21 generate heat in coordination with the timing with which the ink dot 50 on the recording medium 1 passes across the heating region R21.

As described above, as shown in FIGS. 7 and 9, the control portion 110 can make the heating region R21 generate heat with it at rest at a predetermined position.

As described above, as shown in FIGS. 10 and 11, the control portion 110 can move the heating region R21 to the downstream side in the recording medium conveyance direction according to the movement of the ink dot 50. With this configuration, it is possible to increase the time during which the ink dot 50 on the recording medium 1 passes across the heating region R21, and thus to lower the set temperature of the heating region R21 (lower the temperature of the top surface of the recording medium 1). Thus, even when the recording medium 1 has relatively low resistance to heat, it is possible to prevent the recording medium 1 from thermally deforming.

As described above, the control portion 110 makes the heating region R21 generate heat in coordination with the timing with which the ink dot 50 is located substantially opposite the heating region R21 while the heating region R21 is generating heat. This makes it possible to reduce heat loss; it is thus possible to efficiently dry the ink dot 50 on the recording medium 1, and to prevent surplus heat from conducting to the recording heads 10*a* to 10*d*.

As described above, the control portion 110 makes the heating region R21 generate heat with the timing with which 80% or more of the area of the ink dot 50 passes across the heating region R21 while the heating region R21 is generating heat. This makes it possible to reduce heat loss sufficiently.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, although the above-described embodiment deals with an example in which the recording medium 1 in a roll is used, this is in no way meant to limit the present disclosure; instead, a recording medium 1 cut in a predetermined size (for example, in A4 size) may be used.

Although the above-described embodiment deals with an example in which aqueous ink is used, this is in no way meant to limit the present disclosure; instead, non-aqueous ink such as organic solvent-based ink may be used.

Although the above-described embodiment deals with an example in which the slide layer 41 formed with, for example, a glass plate, is provided on each of the thermal heads 20*a* to 20*d*, this is in no way meant to limit the present disclosure. Instead, the slide layer 41 may be provided by coating the top surfaces of the thermal heads 20*a* to 20*d* with fluororesin or the like.

Figure 13:
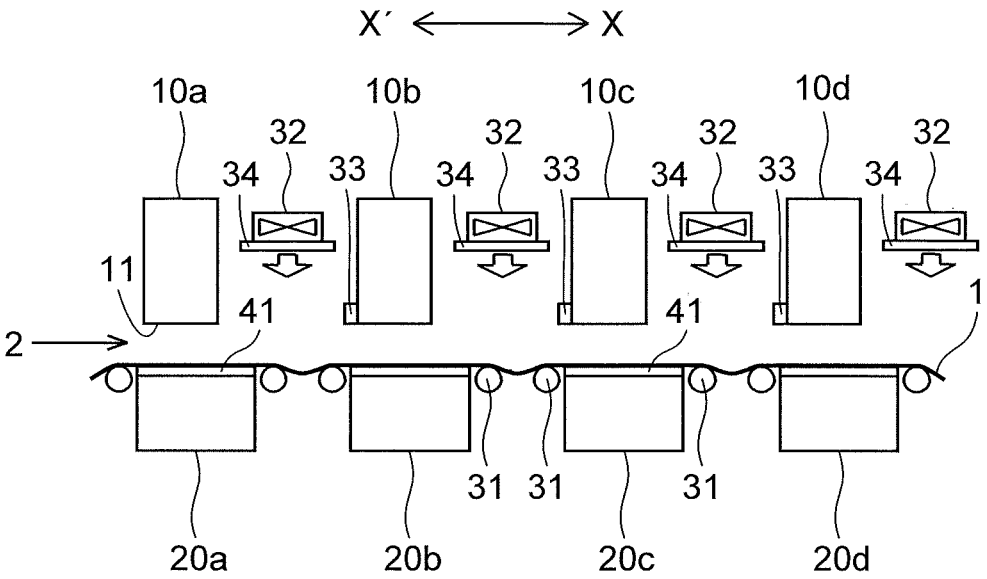
FIG. 13 is a diagram showing a structure around recording heads and thermal heads in an inkjet recording apparatus according to a modified example of the present disclosure, showing a structure in which auxiliary heating devices are provided which heat a recording medium from the top surface side.

Although the above-described embodiment deals with an example in which the recording medium 1 is heated from its reverse side by use of the thermal heads 20*a* to 20*d*, this is in no way meant to limit the present disclosure. For example, as in the inkjet recording apparatus 100 according to a modified example of the present disclosure shown in FIG. 13, in addition to the thermal heads 20*a* to 20*d*, auxiliary heating devices 34 may be provided which supplementarily heat the recording medium 1 from the top surface side. Even in this case, as compared with a case in which the recording medium is heated only from the top surface side, it is possible to prevent the temperature of the recording heads 10*a* to 10*d* from rising. An example of suitable use of the auxiliary heating devices 34 is to supplementarily use the auxiliary heating devices 34 at a temperature lower than that of the thermal heads 20*a* to 20*d*, for example, when the thermal heads 20*a* to 20*d* cannot be made to generate sufficient heat because printing has to be performed on a recording medium 1 having low resistance to heat such as PP.

Although the above-described embodiment deals with an example in which a plurality of recording heads 20*a* to 20*d* are provided along the recording medium conveyance direction, this is in no way meant to limit the present disclosure; instead, only a single recording head may be provided along the recording medium conveyance direction.

Although the above-described embodiment deals with an example in which the control portion 110, when changing, according to the kind of the recording medium 1, at least either the amount of heat generated in the heating region R21 or the length of the heating region R21, changes, according to the thickness of the recording medium 1, at least either the amount of heat generated in the heating region R21 or the length of the heating region R21, this is in no way meant to limit the present disclosure. Instead, the control portion 110 may change, according to the material (the thermal conductivity) of the recording medium 1, at least either the amount of heat generated in the heating region R21 or the length of the heating region R21.

Although the above-described embodiment deals with an example in which the supporting members 31 are provided on the upstream and downstream sides of each of the thermal heads 20*a* to 20*d* in the recording medium conveyance direction, this is in no way meant to limit the present disclosure; there is no need to provide the supporting members 31.

Although the above-described embodiment deals with an example in which the slide layers 41 are provided on the top surfaces of the thermal heads 20*a* to 20*d*, this is in no way meant to limit the present disclosure; there is no need to provide the slide layers 41 on the top surfaces of the thermal heads 20*a* to 20*d*.

What is claimed is:

1. An inkjet recording apparatus comprising:

a recording head having an ink discharge surface in which a plurality of ink discharge ports are open through which ink is discharged to a recording medium;

a thermal head arranged opposite the ink discharge surface across a recording medium conveyance passage, the thermal head heating the recording medium; and a heat control portion which controls the thermal head, wherein the thermal head is provided with a plurality of element arrays in a width direction orthogonal to a recording medium conveyance direction such that the element arrays each correspond to one or more ink discharge ports, the plurality of element arrays each having a plurality of heating elements arrayed in the recording medium conveyance direction, the element arrays are arranged, with respect to the recording medium conveyance direction, at least downstream of a landing position at which the ink discharged through the ink discharge ports lands on the recording medium, and the heat control portion is capable of selectively making the plurality of heating elements generate heat, makes generate heat at least some of the heating elements in the element arrays corresponding to the ink discharge ports through which ink is discharged, and makes a heating region generate heat in coordination with timing with which an ink dot on the recording medium passes through the recording medium conveyance passage, the heating region being where the heating elements in the element arrays are made to generate.

2. The inkjet recording apparatus of claim 1, wherein a plurality of the recording heads are provided along the recording medium conveyance direction, and a plurality of the thermal heads are provided along the recording medium conveyance direction.

3. The inkjet recording apparatus of claim 1, wherein the heat control portion makes the heating region generate heat with predetermined timing based on a conveying speed of the recording medium and a distance from the landing position to the heating region.

4. The inkjet recording apparatus of claim 1, wherein the heat control portion makes the heating region generate heat with the heating region at rest at a predetermined position.

5. The inkjet recording apparatus of claim 1, wherein the heat control portion makes the heating region generate heat with timing with which the ink dot is located substantially opposite the heating region while the heating region is generating heat.

6. The inkjet recording apparatus of claim 5, wherein the heat control portion makes the heating region generate heat with timing with which 80% or more of an area of the ink dot passes across the heating region while the heating region is generating heat.

* * * * *